US009765783B2

(12) United States Patent
Yanagawa et al.

(10) Patent No.: US 9,765,783 B2
(45) Date of Patent: Sep. 19, 2017

(54) VANE-ROTARY GAS COMPRESSOR

(71) Applicant: Calsonic Kansei Corporation, Saitama-shi (JP)

(72) Inventors: Eiki Yanagawa, Saitama (JP); Keisuke Nakazawa, Saitama (JP)

(73) Assignee: Calsonic Kansei Corporation, Saitama-Shi (JP)

( * ) Notice: Subject to any disclaimer, the term of this patent is extended or adjusted under 35 U.S.C. 154(b) by 142 days.

(21) Appl. No.: 14/658,612

(22) Filed: Mar. 16, 2015

(65) Prior Publication Data

US 2015/0267703 A1 Sep. 24, 2015

(30) Foreign Application Priority Data

Mar. 19, 2014 (JP) ..... 2014-057062

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 18/344*** | (2006.01) |

(Continued)

(52) U.S. Cl.

CPC ..... *F04C 18/3446* (2013.01); *F01C 21/0863* (2013.01); *F04C 18/344* (2013.01); *F04C 29/026* (2013.01); *F01C 21/0809* (2013.01); *F01C 21/0872* (2013.01); *F04C 29/02* (2013.01)

(58) Field of Classification Search

CPC .. F04C 23/008; F04C 18/344; F04C 18/3446; F04C 18/321; F04C 29/02; F04C 29/023; F04C 29/025; F04C 29/026; F04C 29/124; F04C 29/123; F01C 21/0809; F01C 21/0872; F01C 21/0863

USPC ..... 418/259, 266–268, 270, DIG. 1, 75–76, 418/82, 93, 94

See application file for complete search history.

(56) References Cited

U.S. PATENT DOCUMENTS

| | | | | |
|---|---|---|---|---|
| 4,653,991 A * | 3/1987 | Takao | ..... | F01C 21/0809 418/82 |
| 7,150,610 B2 * | 12/2006 | Takahashi | ..... | F01C 21/0809 418/82 |
| 2002/0119054 A1 | 8/2002 | Morita | | |

FOREIGN PATENT DOCUMENTS

| | | |
|---|---|---|
| CN | 1373298 A | 10/2002 |
| CN | 103423162 A | 12/2013 |

(Continued)

*Primary Examiner* — Theresa Trieu

(74) *Attorney, Agent, or Firm* — Locke Lord LLP; Howard M. Gitten

(57) ABSTRACT

A gas compressor comprising a compressor main body including an approximately cylindrical rotor, a cylinder, a plurality of plate-like vanes formed to abut on the inner circumferential surface of the cylinder, and two side blocks is disclosed. A plurality of compression rooms is arranged inside the compressor main body so as to compress a medium and discharge the compressed high-pressure medium. A back-pressure-supplying groove supplies the back-pressure so as to project the vane toward the inner circumferential surface of the cylinder is arranged. An outer circumferential edge portion of the back-pressure-supplying groove is formed so as to increase a distance from a rotational center of the rotor toward the front side in the rotational direction of the rotor. A sectional surface area of a communication portion between the vane groove and the back-pressure-supplying groove increases until they are separated according to the rotation of the rotor.

3 Claims, 7 Drawing Sheets

(51) Int. Cl.
*F04C 29/02* (2006.01)
*F01C 21/08* (2006.01)

(56) References Cited

FOREIGN PATENT DOCUMENTS

| | | | |
|---|---|---|---|
| JP | 59-192885 | A | 11/1984 |
| JP | 63-186982 | A | 8/1988 |
| JP | 2000-257576 | A | 9/2000 |
| JP | 2002-048081 | A | 2/2002 |

* cited by examiner

--Prior Art--

VANE-ROTARY GAS COMPRESSOR

CROSS-REFERENCE TO RELATED APPLICATION

The present application is based on and claims priority from Japanese Patent Application No. 2014-057062, filed on Mar. 19, 2014, the disclosure of which is hereby incorporated by reference herein in its entirety.

BACKGROUND

Field of the Invention

The present invention relates to a gas compressor disposed, for example, in an air conditioner installed in a vehicle and so on.

For example, an air conditioner for controlling an air temperature inside a vehicle is disposed in a vehicle such as an automobile. Such an air conditioner includes a loop cycle of refrigeration so as to circulate a refrigerant (cooling medium). The refrigeration cycle includes an evaporator, a gas compressor, a condenser, and an expansion valve, in order. The gas compressor in the air conditioner compresses a cooling medium in the form of gas which is vaporized by the evaporator and sends it toward the condenser as a high-pressure refrigerant gas.

As such a gas compressor, a vane-rotary type gas compressor which includes an approximately ellipsoidal cylinder and a rotor rotatably supported in the cylinder is conventionally known. In such a compressor, the rotor includes a plurality of vanes projectably and retractably disposed such that respective leading ends of the vanes slidably contact with an inner circumferential surface of the cylinder (for example, refer to Patent Document 1: Japanese Patent laid-open No. 2000-257576).

The vane-rotary type gas compressor according to Patent Document 1 includes a compressor maw body comprising a rotor which can rotate integrally with a rotational axis, a cylinder configured such that a sectional contour of an inner circumferential surface surrounds an outer circumferential surface of the rotor front the outside, a plurality of vanes arranged to be projectable from the outer circumferential surface of the rotor toward the inner circumferential surface of the cylinder, and two side blocks which cover both ends of the rotor and the cylinder and support both sides of the rotational axis to be rotatable.

By decreasing a volume of a compression room which is sectioned and formed between the outer circumferential surface of the rotor and the inner circumferential surface of the cylinder by two vanes next to each other along the rotational direction of the rotor in accordance with the rotation of the rotor, the compressor main body compresses the low-pressure refrigerant gas which is conducted into the compression room and discharges the compressed high-pressure refrigerant gas toward a discharge room. The discharged high-pressure (hereinafter, referred to as a discharge pressure) refrigerant gas is discharged outside after oil which is accumulated in the refrigerant gas is separated from the gas. The separated oil is accumulated in a bottom portion of the discharge room.

The oil accumulated in the bottom portion of the discharge room (refrigerant oil, and so on) receives a pressure front the refrigerant gas having the discharge pressure discharged to the discharge room, and is supplied to the vane groove through a drain groove which is formed on the end surface of each side blocks on the rotor side through an oil path formed in two side blocks and the cylinder. Then, the oil functions as back-pressure so that the end side portion of the vane can project from the vane groove. Herein, the oil which is supplied to the vane groove from the discharge room through the oil path and the drain groove has a medium pressure which is lower than the discharge pressure of the air inside the discharge room because of the pressure drop caused by the fact that it passes through a narrow clearance formed between a shaft and the outer circumferential surface of the rotational axis.

Herein, because the back-pressure of the vane (medium pressure) is lower than that in the general performance shortly after starting the gas compressor, and the pressure inside the compression room exceeds the centrifugal force due to the back-pressure at medium pressure and the rotation of the vane, in the final stage of the compression process, there may be the case in which chattering (repetition of separation and collision between the leading end portion of the vane and the inner circumferential surface of the cylinder) is generated.

Therefore, because the bottom portion of the vane groove which communicates with the drain groove in accordance with the rotation of the rotor is separated from the drain groove in the final stage of the compression process of the refrigerant gas, that is, the bottom portion of the vane groove and drain groove enters into a non-communicating condition, the oil is confined in the bottom portion of the vane groove. Thereby, when the vane moves in a direction in which it is retracted by sliding on the inner circumferential surface of the cylinder, the volume inside the vane groove becomes smaller, so inside the vane groove becomes high-pressure which is higher than the discharge pressure, then the high-pressure which is higher than the discharge pressure can be supplied to the vane as the back-pressure. Thereby, the chattering can be prevented.

The sectional area of the communication portion between the drain groove and the bottom portion of the vane groove gradually decreases from the communicating zone of the drain groove and the bottom portion of the vane groove to the non-communicating zone of the drain groove and the bottom portion of the vane groove in the compression process of the refrigerant gas. Herein, the back-pressure rises as the communicating area of the drain groove and the bottom portion of the vane groove decreases.

The quantity of oil which is supplied from the drain groove to the bottom portion of the vane groove in a low-speed operation increases to be larger than that in a high-speed operation between such a section (section between the portion in which the drain groove and the bottom portion of the vane groove communicates to each other and the portion in which the drain groove and the bottom section of the vane groove are separated). Therefore, the predetermined quantity of oil in the bottom portion of the vane groove cannot flow toward the drain groove side before the drain groove is separated from the bottom portion of the vane groove, so the back-pressure tends to rise. Thus, the quantity of oil in the bottom section of the vane groove (back-pressure space) increases and a problem may occur such as the back-pressure excessively rising in a high-speed operation and the abraded amount increasing because the leading end portion of the vane strongly rubs the inner circumferential surface of the cylinder.

SUMMARY

Therefore, the present invention has been made in order to provide a gas compressor which can prevent the generation of chattering of a vane and the abrasion caused due to the fact that a leading end portion of the vane strongly rubs an inner circumferential surface of a cylinder by an excessive rise of back-pressure.

In order to accomplish the above-described object, the gas compressor according to the present invention comprises: a compressor main body including an approximately cylindrical rotor which rotates integrally with a rotational axis, a cylinder including an inner circumferential surface having a contour shape so as to surround an outer circumferential surface of the rotor from an outer side of the rotor, a plurality of plate-like vanes slidably inserted into a vane groove formed in the rotor, each of the plurality of plate-like vanes having a leading end portion formed to abut on the inner circumferential surface of the cylinder through a hack-pressure from the vane groove, and two side blocks which cover each leading end portion of both of the rotor and the cylinder, wherein a plurality of compression rooms which are partitioned by the outer circumferential surface of the rotor, the inner circumferential surface of the cylinder, each inside surface of both side blocks, and the vane is arranged inside the compressor main body so as to compress a compression medium supplied to the compression room and discharge the compressed high-pressure medium. A back-pressure-supplying groove which communicates with a bottom portion of the vane groove during compression process of the compression medium and supplies the hack-pressure to the bottom portion of the vane so as to project the vane toward the inner circumferential surface of the cylinder is arranged on a surface facing an end surface of the rotor on at least one of the two side blocks. An outer circumferential edge portion of the back-pressure-supplying groove is formed so as to increase a distance from as rotational center of the rotor toward the front side in the rotational direction of the rotor. A sectional surface area of a communication portion between the bottom portion of the vane groove and the leading end portion, of the back-pressure-supplying groove on the front side in the rotational direction of the rotor increases until the bottom portion of the vane groove and the leading end portion of the back-pressure-supplying groove are separated according to the rotation of the rotor in a final stage of the compression process of the compression medium in the compression room.

BRIEF DESCRIPTION OF THE DRAWINGS

The accompanying drawings are included to provide further understanding of the invention, and are incorporated in and constitute a part of this specification. The drawings illustrate Embodiments of the invention and, together with the specification, serve to explain the principle of the invention.

DETAILED DESCRIPTION OF THE PREFERRED EMBODIMENTS

Hereinafter, Embodiments of the present invention will be described with reference to the drawings.

Embodiment 1

Figure 1:
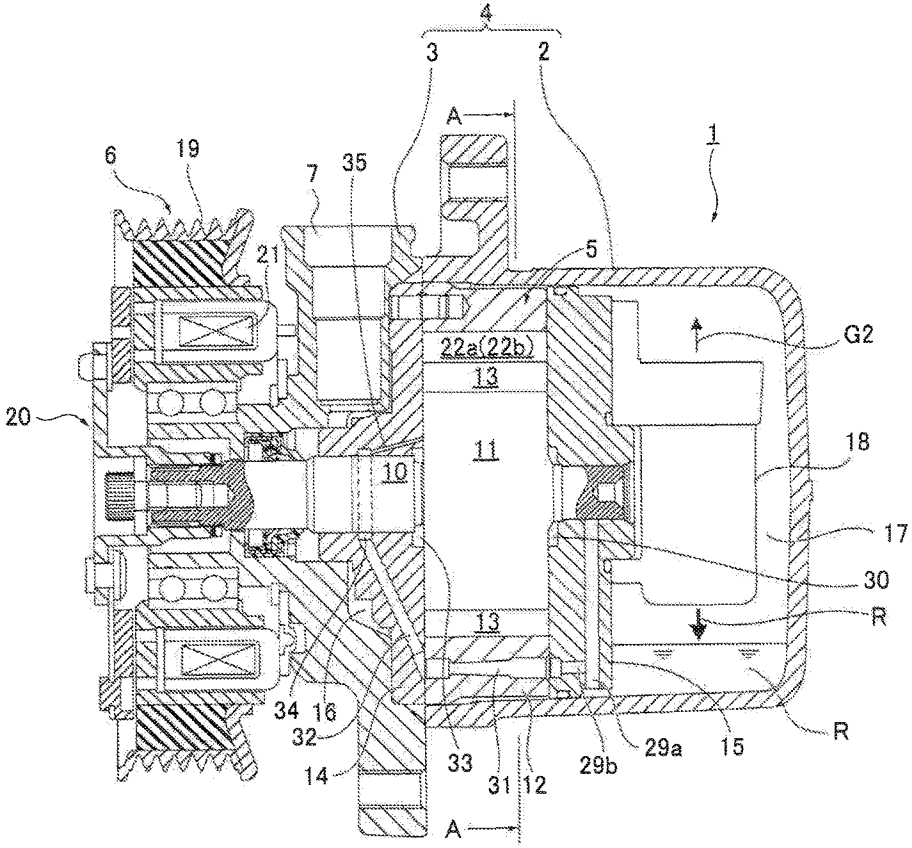
FIG. 1 schematically illustrates a sectional view of a gas compressor according to Embodiment 1 of the present invention (vane-rotary type gas compressor).

FIG. 1 schematically illustrates a sectional view of a vane-rotary type gas compressor (hereinafter, referred to as compressor) as an example of a gas compressor according to Embodiment 1 of the present invention.

[Entire Configuration of Compressor 1]

The compressor 1 shown in the figure is configured, for example, as a part of an air-conditioning system which performs a cooling operation through heat of evaporation of a cooling medium, and arranged on a circulation path of the cooling medium with the other components of the air conditioning system, such as a condenser, an expansion valve, and an evaporator (neither of these are shown in figures). As the air-conditioning system, an air conditioner installed in a vehicle (automobile and so on) in order to control the temperature inside the vehicle is considered for example.

The compressor 1 compresses a refrigerant gas as a gaseous cooling medium which is drawn from the evaporator in the air-conditioning system and supplies the compressed refrigerant gas to the condenser of the air conditioning system. The condenser condenses the compressed refrigerant gas and sends out the refrigerant gas to the expansion valve as high-pressure liquid refrigerant. The high-pressure liquid refrigerant becomes low pressure through the expansion valve, and is sent out to the evaporator. The low-pressure liquid cooling medium is vaporized in the evaporator by absorbing heat from air around, and cools the air around the evaporator through the heat exchange with the heat of vaporization.

As shown in FIG. 1, the compressor 1 includes an approximately cylindrical main body case 2 having one opening-end portion (left side in FIG. 1) and the other closed-end portion, a front head 3 which covers the opening-end portion of the main body case 2, a compressor main body 5 which is housed in a housing 4 including the main body case 2 and the front head 3, and an electromagnetic clutch 6 which is disposed to transmit a driving force from an engine (not shown) of a vehicle (automobile) as a driving source to the compressor main body 5.

The front head 3 is shaped like a flap so as to cover the opening-end surface of the main body case 2, and it is fixed around the opening-end portion on one side of the main body case 2 by a bolt. The front head 3 includes a suction port 7 which sucks the low-pressure refrigerant gas from the evaporator (not shown) in the air-conditioning system, and the main body case 2 includes a discharge port (not shown)

which discharges the high-pressure refrigerant gas compressed by the compressor main body 5 towards the condenser (not shown) in the air-conditioning system.

Figure 2:
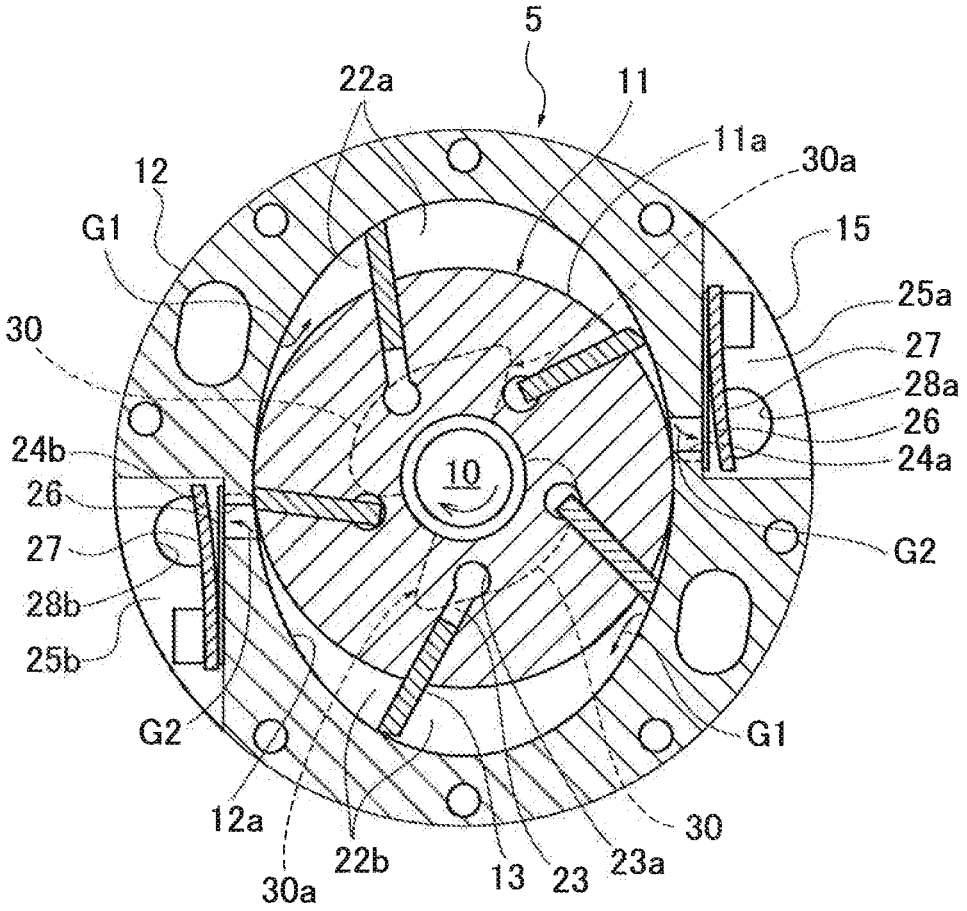
FIG. 2 illustrates a sectional view of the gas compressor along A-A line in FIG. 1.

As shown in FIG. 2, the compressor main body 5 includes an approximately cylindrical rotor 11 which rotates integrally with a rotational axis 10, an approximately ellipsoidal cylinder 12 having an inner circumferential surface 12*a* surrounding an outer circumferential surface 11*a* of the rotor 11 from the outside, a plurality of (five in the figures) plate-like vanes 13 arranged to be projectable from the outer circumferential surface 11*a* of the rotor 11 toward the inner circumferential surface 12*a* of the cylinder 12, and two side blocks which are fixed so as to cover each end surface of both the rotor 11 and cylinder 12 (front side block 14 and rear side block 15 shown in FIG. 1). FIG. 2 is a sectional view of the gas compressor along A-A line in FIG. 1. In FIG. 2, the main body case 2 of the outer circumferential surface side of the compressor main body 5 is not shown.

A suction room 16 (refer to FIG. 1) is arranged between the front head 3 and the front side block 14, and a discharge room 17 is arranged in the main body case 2 on the rear side block 15 side. An oil separator 1$ is arranged on an outer end surface of the rear side block 15 so as to be placed in the discharge room 17. FIG. 1 shows an external appearance of the oil separator 18 which is disposed in the discharge room 17, not a sectional view of the oil separator.

An outer end surface of the front side block 14 is fastened and fixed by a plurality of bolts to the inner circumferential surface of the front head 3 around the opening-end portion. On the other hand, the outer circumferential surface of the rear side block 15 is fitted to the inner circumferential surface of the main body case 2. Thus, the front side block 14 side portion of the compressor main body 5 housed in the housing 4 is fastened and fixed by a bolt to the front head 3, and the rear side block 15 side portion of the compressor main body 5 is held so as to fit to the inner circumferential surface of the housing 2.

The electromagnetic clutch 6 is arranged on the outer surface side of the front head 3, thereby a rotational driving force from the engine is transmitted to a pulley 19 through a belt (not shown), One end portion (left side portion in FIG. 1) of the rotational axis 10 is fitted to a through-hole in the center of an armature 20 in the electromagnetic clutch 6. Herein, the rotational axis 10 is rotatably supported in a through-hole in the center of the front side block 14 and rear side block 15.

During the operation of the compressor 1 (compressor main body 5), the armature 20 is absorbed on the side surface of the pulley 19 by the excitation of an electromagnet 21 which is arranged inside the pulley 19, and thereby, the driving force from the engine which is transmitted to the pulley 19 through a belt (not shown) is further transmitted to the rotational axis 10 (rotor 11) through the armature 20.

[Configuration and Operation of Compressor Main Body 5]

As shown in FIG. 2, a plurality of compression rooms 22*a* and 22*b* partitioned by five vanes 13 arranged at even intervals is formed in a space among the inner circumferential surface 12*a* of the cylinder 12, the outer circumferential surface 11*a* of the rotor 11, and both side blocks 14 and 15 (refer to FIG. 1).

Each vane 13 is arranged slidably in a vane groove 23 which is formed in the rotor 11 and projects from the outer circumferential surface 11*a* of the rotor 11 toward the outside by the back-pressure of refrigerant, oil which is supplied to a bottom portion 23*a* of the vane groove 23. In FIG. 2, the compression room which is formed in an upper space between the inner circumferential surface 12*a* of the cylinder 12 and the outer circumferential surface 11*a* of the rotor 11 is represented as the compression room 22*a*, and the compression room which is formed in a lower space between the inner circumferential surface 12*a* of the cylinder 12 and the outer circumferential surface 11*a* of the rotor 11 is represented as the compression room 22*b*.

The sectional surface of the inner circumferential surface 12*a* of the cylinder 12 on a portion surrounding the outer circumferential surface 11*a* of the rotor 11 has an approximately ellipsoidal shape. The volume of each compression room 22*a* and 22*b* repeatedly increases and decreases during the suction process and compression process of the refrigerant gas in accordance with the rotation of the rotor 11. The compressor 1 (compressor main body 5) of Embodiment 1 includes two suction processes and a compression process during one rotation of the rotor 11.

The cylinder 12 includes each suction hole (not shown) in order to suck the refrigerant gas G1 into each compression room 22*a* and 22*b*, and each discharge hole 24*a* and 24*b* in order to discharge the refrigerant gas G2 which is compressed through each compression room 22*a* and 22*b*.

In detail, the low-pressure refrigerant gas G1 which is supplied from the suction room 16 is sucked into the compression rooms 22*a* and 22*b* through each suction hole (not shown) formed in the cylinder 12 during the process in which each volume of the compression room 22*a* and 22*b* increases, and the refrigerant gas which is confined in the compression rooms 22*a* and 22*b* is compressed during the process in which the volume of the compression rooms 22*a* and 22*b* decreases. Thereby, the refrigerant gas becomes high-temperature and high-pressure gas. Then, the high-temperature and high-pressure refrigerant gas G2 is discharged through each discharge hole 24*a* and 24*b* toward discharge chambers 25*a* and 25*b* as the space partitioned by the cylinder 12, housing 2, and both side blocks 14 and 15 is surrounded.

Each discharge chamber 25*a* and 25*b* includes a discharge valve 26 which prevents the backward flow of the refrigerant gas toward the compression rooms 22*a* and 22*b* side, and a valve support member 27 which prevents the discharge valve 26 from excessively deforming (warpage). The high-temperature and high-pressure refrigerant gas G2 which is discharged from discharge holes 24*a* and 24*b* toward discharge chambers 25*a* and 25*b* is conducted into the oil separator 18 disposed in the discharge room 17 from discharge openings 28*a* and 28*b* formed in the rear side block 15.

The oil separator 18 separates the refrigerant oil which is included with the refrigerant gas (oil for a vane back-pressure which is leaked into the compression rooms 22*a* and 22*b* from the vane groove 23 formed in the rotor 11) from the refrigerant gas by use of the centrifugal force. In detail, the high-pressure refrigerant gas G2 from the compression rooms 22*a* and 22*b* is discharged toward each discharge hole 24*a* and 24*b*, and is conducted into the oil separator 18 through the discharge chambers 25*a* and 25*b* and the discharge openings 28*a* and 28*b*, and so on. Thereby, the refrigerant gas is circulated spirally along the inner circumferential surface of the oil separator 18 so as to separate the refrigerant oil included in the refrigerant gas from the refrigerant gas by the centrifugal force.

As shown in FIG. 1, the refrigerant oil R which is separated from the refrigerant gas G2 in the oil separator 18 is accumulated in the bottom portion of the discharge room 17, and the high-pressure (discharge pressure) refrigerant gas G2 after the separation of the refrigerant oil is discharged from the discharge room 17 through the discharge port (not shown) toward an external condenser (not shown).

The refrigerant oil R which is confined in the bottom portion of the discharge room 17 is supplied to the bottom portion 23*a* of the vane groove 23 through an oil path 29*a* formed in the rear side block 15 and the drain groove 30 (refer to FIG. 2) for supplying a back-pressure, by the high-pressure atmosphere caused by the refrigerant gas G2 of the discharge pressure which is discharged to the discharge room 17. Thus, the back-pressure which enables the vane 13 to project outside is obtained.

Similarly, the refrigerant oil R accumulated in the bottom portion of the discharge room 17 is supplied to the bottom portion 23*a* of the vane groove 23 through the oil paths 29*a* and 29*b* formed in the rear side block 15, an oil path 31 formed in the cylinder 12, an oil path 32 formed in the front side block 14, and a drain groove 33 for supplying the back-pressure (refer to FIG. 3) by the high-pressure atmosphere caused by the refrigerant gas of the discharge pressure discharged in the discharge room 17. Thus, the back-pressure which enables the vane 13 to project outside is obtained.

Figure 3:
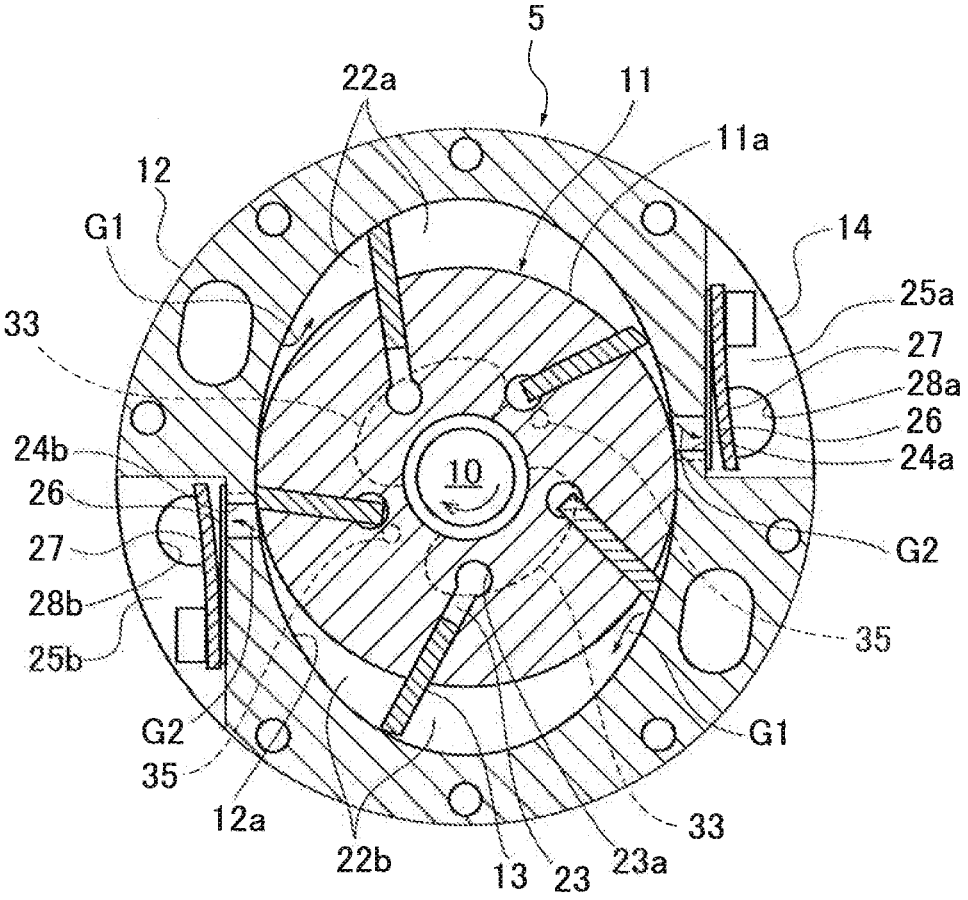
FIG. 3 illustrates a drain groove on a front side block side and a high-pressure-supplying hole which are arranged in the gas compressor according to Embodiment 1 of the present invention.

FIG. 3 illustrates the drain groove 33 on the front side block 14 side. The outer circumferential end of the drain groove 33 on the front side in the rotational direction of the rotor does not project but curves internally in the radial direction, similar to a later-described drain groove 30 on the rear side block 15 side.

The refrigerant oil R which is supplied to the vane groove 23 through the drain grooves 30 and 33 has a medium pressure which is lower than that of the discharge atmosphere inside the discharge room 17 as a result of an influence of the pressure drop caused by the fact that the refrigerant oil R passes through a narrow clearance formed between a shaft bearing and the outer circumferential surface of the rotational axis 10.

The compressor 1 of Embodiment 1 includes a ring-shaped oil groove 34 and a high-pressure-supplying hole 35 (refer to FIG. 1 and FIG. 3) in the front side block 14 so as to communicate with the oil path 32 in the front side block 14 in order to supply the refrigerant oil R having higher pressure than the medium pressure to the bottom portion 23*a* of the vane groove 23.

Figure 4:
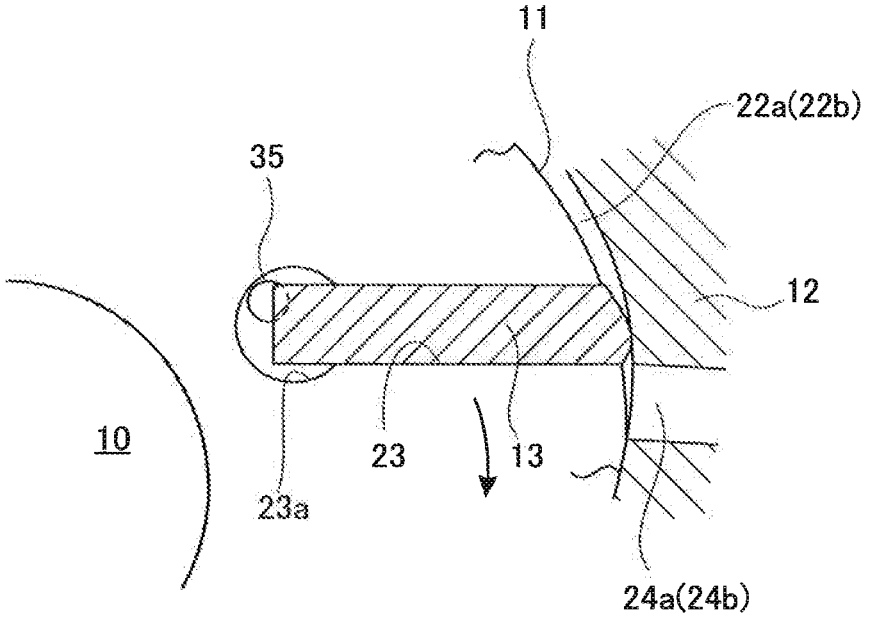
FIG. 4 schematically illustrates a condition in which the high-pressure-supplying hole communicates with a bottom portion of the vane groove of the gas compressor in the final stage of the compression process of the refrigerant gas.

The oil groove 34 is formed along the outer circumferential surface of the rotational axis 10. One end portion of the high-pressure-supplying hole 35 communicates with the oil groove 34 and the other end portion opens to the end surface of the front side block 14 on the rotor 11 side. As shown in FIG. 4, the high-pressure-supplying hole 35 is configured so as to communicate with the bottom portion 23*a* of the vane groove 23 when the bottom portion 23*a* of the vane groove 23 and the drain groove 33 are separated so as to be under a non-communication state from the communication state in which the bottom portion 23*a* of the vane groove 23 communicates with the drain groove 33 in the final stage of the compression process.

Thereby, in the final stage of the compression process (state just before the refrigerant gas is discharged), the refrigerant oil R in the discharge room 17 is supplied as the vane back-pressure to the bottom portion 23*a* of the vane groove 23 through the oil paths 29*a* and 29*b* formed in the rear side block 15, the oil path 31 formed in the cylinder 12, the oil path 32 formed in the front side, block 14, the oil groove 34, and the high-pressure-supplying hole 35 by the high-pressure atmosphere caused by the refrigerant gas of the discharge pressure which is discharged to the discharge room 17. The vane back-pressure herein has a level which is almost the same as the discharge pressure (higher than the medium pressure) of the refrigerant gas discharged to the discharge room 17 because the pressure drop in the supplying path is small.

Next, the drain groove 30 formed in the rear side block 15 as a back-pressure-supplying groove will be described in detail.

As shown in FIG. 2, the drain groove 30 is arranged on the end surface of the rear side block 15 on the rotor 11 side. The contour shape of the outer circumferential side of the drain groove 30 has an approximately semicircular shape and the drain groove 30 includes a concave configuration. The drain groove 30 is configured to have a predetermined angle range around the shaft of the rotational axis 10. The drain groove 30 communicates with the bottom portion 23*a* having an expanded diameter in the vane groove 23 during the compression process of the refrigerant gas in accordance with the rotation of the rotor 11. Thereby, the refrigerant oil R accumulated in the bottom portion of the discharge room 17 is supplied as a vane back-pressure to the bottom portion 23*a* of the vane groove 23 through the oil path 29*a* formed in the rear side block 15 and the vane groove 30 by the high-pressure atmosphere obtained by the discharged refrigerant gas of the discharge pressure which is discharged to the discharge room 17.

In the above-described situation, because the bottom portion 23*a* of the vane groove 23 is separated from a leading end portion 30*a* of the drain-groove on the front side in the rotational direction of the rotor 11 in the drain groove 30 (hereinafter, referred to as just a leading end portion of the drain groove) in accordance with the rotation of the rotor 11 in the final stage of the compression process of the refrigerant gas, that is, a communicating condition in which the bottom portion 23*a* of the vane groove 23 communicates with the leading end portion 30*a* of the drain groove is changed to a non-communicating condition in which the drain groove 30 (leading end portion 30*a* of the drain-groove) is separated from the bottom portion 23*a* of the vane groove 23, the refrigerant oil R is accumulated in the bottom portion 23*a* of the vane groove 23 so as to raise the vane back-pressure. As a result of raising the vane back-pressure, the vane 13 can be prevented from chattering.

Figure 5:
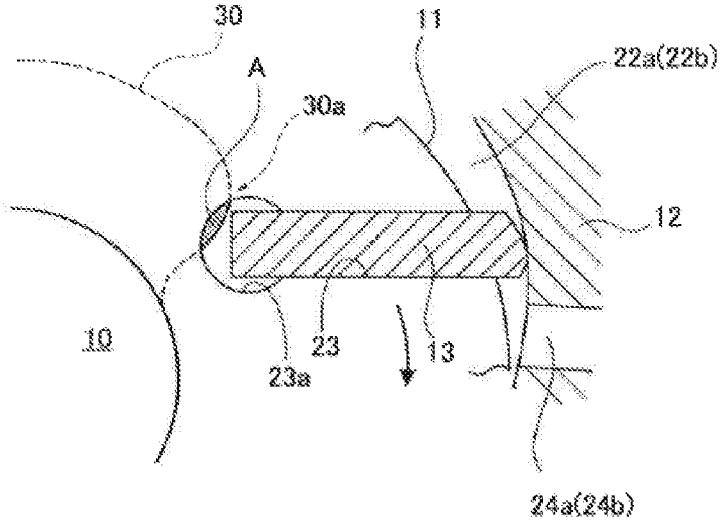
FIG. 5 illustrates a condition in the final stage of the compression process of refrigerant gas in a comparative example (conventional example), which is before a bottom portion of a vane groove separates from a leading end portion of a drain groove.

On the other hand, as shown in a comparative example (conventional example) in FIG. 5, before the bottom portion 23*a* of the vane groove 23 which communicates with the drain groove 30 is separated from the leading end portion 30*a* of the drain groove having a curvature in the drain groove 30 on the front side in the rotational direction of the rotor in the final stage of the compression process of the refrigerant gas, the sectional area A of the portion in which the bottom portion 23*a* and the leading end portion 30*a* of the drain groove 30 are communicated with each other becomes small. That is, the outer circumferential edge portion of the leading end portion 30*a* of the drain groove 30 is not configured to increase the distance from the rotational center of the rotor toward the front side in the rotational direction of the rotor but it has a curvature directed to the inside in the radial direction, in the comparative example (conventional example) as shown in FIG. 5.

Thereby, because the flow rate of the refrigerant oil which is supplied to the bottom portion 23*a* of the vane groove 23 from the drain groove 30 increases in a high-speed operation, if the sectional surface area A of the communication portion is small, and before the bottom portion 23*a* of the vane groove 23 which communicates with the drain groove 30 is separated from the leading end portion 30*a* of the drain groove 30, the back-pressure may excessively rise as a result of the fact that the predetermined quantity of refrigerant oil accumulated in the bottom portion 23*a* of the vane groove 23 cannot flow toward the drain groove 30 side.

Thereby, the leading end portion of the vane 13 strongly rubs the inner circumferential surface 12*a* of the cylinder 12 and the abrasion amount increases. Herein, when the leading end portion of the vane 13 strongly rubs the inner circumferential surface 12*a* of the cylinder 12, a loss in the power required for operating the air compressor 1 increases.

Figure 6:
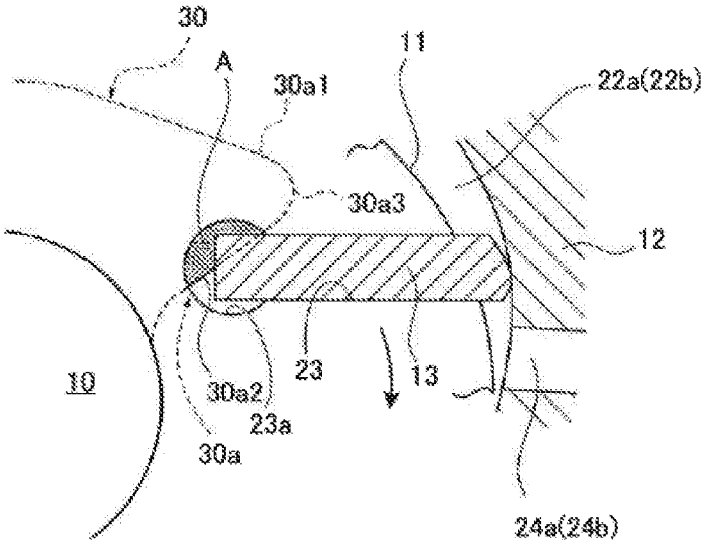
FIG. 6 illustrates a condition of Embodiment 1 in the final stage of the compression process of the refrigerant gas, which is before the bottom portion of the vane groove separates from a leading end portion of the drain groove.

Therefore, in Embodiment 1, as shown in FIG. 6, an outer circumferential edge portion 30*a*1 of the leading end portion 30*a* of the drain groove on the front side in the rotational direction of the rotor in the drain groove 30 is formed so as to increase the distance from the rotational center of the rotor toward the front side of the rotational direction of the rotor. The outer circumferential edge portion 30*a*1 and an end portion 30*a*2 in the circumferential direction of the leading end portion 30*a* of the drain groove are formed linearly and a leading end corner portion 30*a*3 which connects the outer circumferential edge portion 30*a*1 and the end portion 30*a*2 in the circumferential direction is formed so as to configure a radius portion.

As shown in FIG. 6, the bottom portion 23*a* of the vane groove 23 crosses the linearly-shaped end portion 30*a*2 in the circumferential direction before the bottom portion 23*a* in the vane groove 23 which communicates with the drain groove 30 in accordance with the rotation of the rotor 11 is separated from the leading end portion 30*a* of the drain groove 30, in the final stage of the compression process of the refrigerant gas.

Thus, the sectional surface area A of the connection portion between the bottom portion 23*a* of the vane groove 23 and the leading end portion 30*a* of the drain groove (end portion 30*a*2 in the circumferential direction) increases significantly, compared with the comparative example (conventional example) shown in FIG. 5, because the bottom portion 23*a* of the vane groove 23 crosses the linear end portion 30*a*2 in the circumferential direction before the bottom portion 23*a* of the vane groove 23 under the connection condition in accordance with the rotation of the rotor 11 being separated from the leading end portion 30*a* of the drain groove 30 in Embodiment 1.

Therefore, the sectional surface area A between the bottom portion 23*a* and the leading end portion 30*a* (end portion 30*a*2 in the circumferential direction) of the drain groove 30 can be enlarged before the leading end portion 30*a* (end portion 30*a*2 in the circumferential direction) of the drain groove 30 is separated from the bottom portion 23*a* of the vane groove 23 under the communicating condition in accordance with the rotation of the rotor 11.

As described above, because the sectional surface area A of the communication portion can be enlarged before the bottom portion 23*a* of the vane groove 23 under the communicating condition is separated from the leading end portion 30*a* of the drain groove 30, the predetermined quantity of the refrigerant oil accumulated in the bottom portion 23*a* of the vane groove 23 can be flowed (released) toward the drain groove 30 side in the high-speed operation, even if the flow rate of the refrigerant oil supplied to the bottom portion 23*a* of the vane groove 23 from the drain groove 30 increases, for example.

Thereby, the excessive rise of the back-pressure can be prevented under the condition before the bottom portion 23*a* of the vane groove 23 in the communicating condition in accordance with the rotation of the rotor 11 is separated from the leading end portion 30*a* (end portion 30*a*2 in the circumferential direction) of the drain groove 30.

Thereby, the chattering in the vane 13 can be prevented, and the abrasion caused by the fact that the leading end portion of the vane 13 strongly rubs the inner circumferential surface 12*a* of the cylinder 12 can be prevented.

Additionally, in Embodiment 1, the high-pressure-supplying hole 35 is configured so as to communicate with the bottom portion 23*a* of the vane groove 23 after the bottom portion 23*a* of the vane groove 23 is separated from the drain groove 33, that is, the communicating condition in which the bottom portion 23*a* of the vane groove 23 communicates with the drain groove 33 changes to the non-communicating condition in which the vane groove 23 is separated from the drain groove 33 in the final stage of the compression process, as shown in FIG. 4.

Thereby, the chattering in the vane 13 can be prevented even if the pressure in each compression room 22*a* and 22*b* rises, because the refrigerant oil having approximately the same pressure with the discharge pressure is supplied as the vane back-pressure to the bottom portion 23*a* of the vane groove 23 from the high-pressure supply hole 35 in the final stage of the compression process (just before the discharge of refrigerant gas).

Herein, when the back-pressure inside the bottom portion 23*a* rises up to the discharge pressure or more after the bottom portion 23*a* of the vane groove 23 which communicates with the drain groove 33 is separated from the drain groove 33 in the final stage of the compression process, a part of the back-pressure can be released toward the communicating high-pressure-supplying hole 35 side. Thereby, the excessive rise of the back-pressure can be prevented.

Embodiment 2

Figure 7:
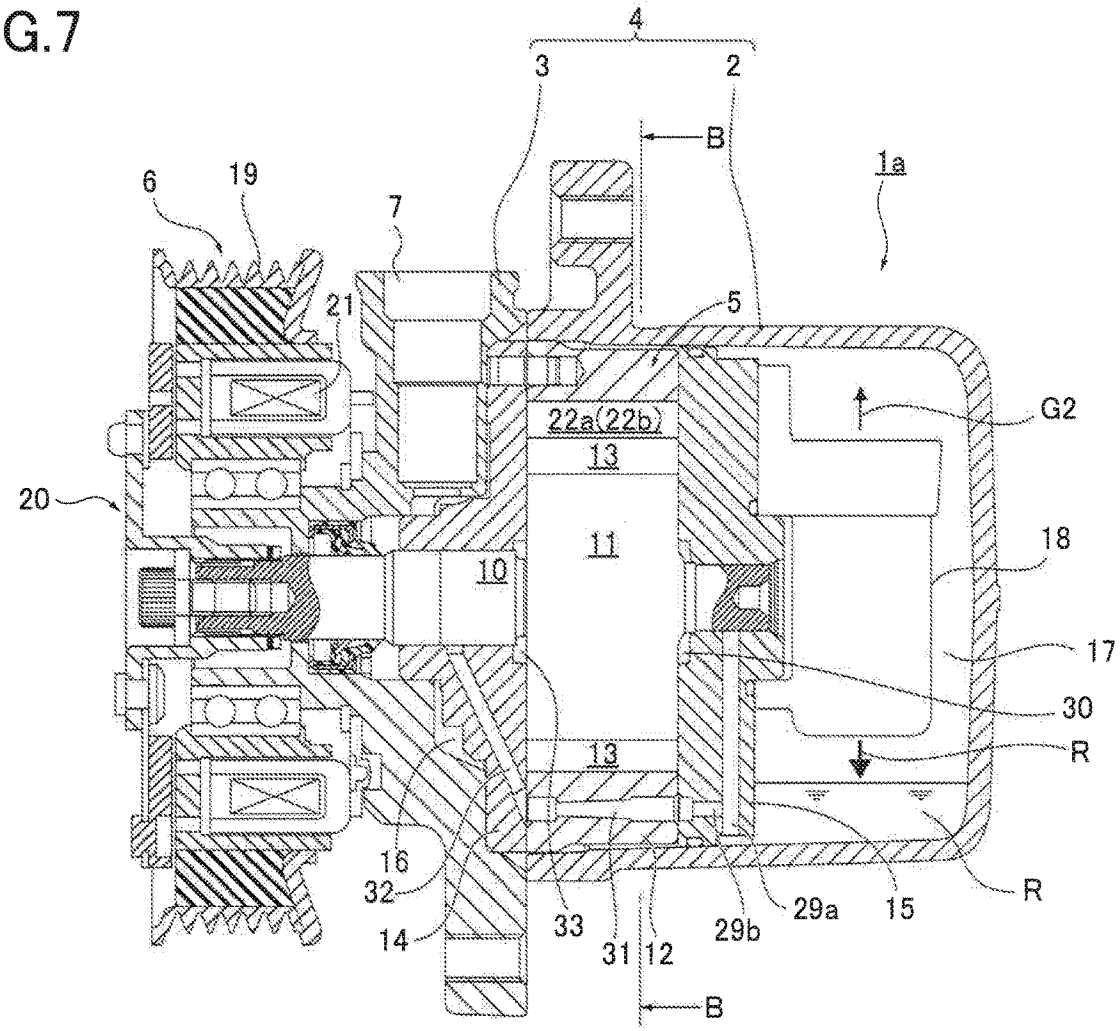
FIG. 7 schematically illustrates a sectional view of a gas compressor (vane-rotary type gas compressor) according to Embodiment 2 of the present invention.
Figure 8:
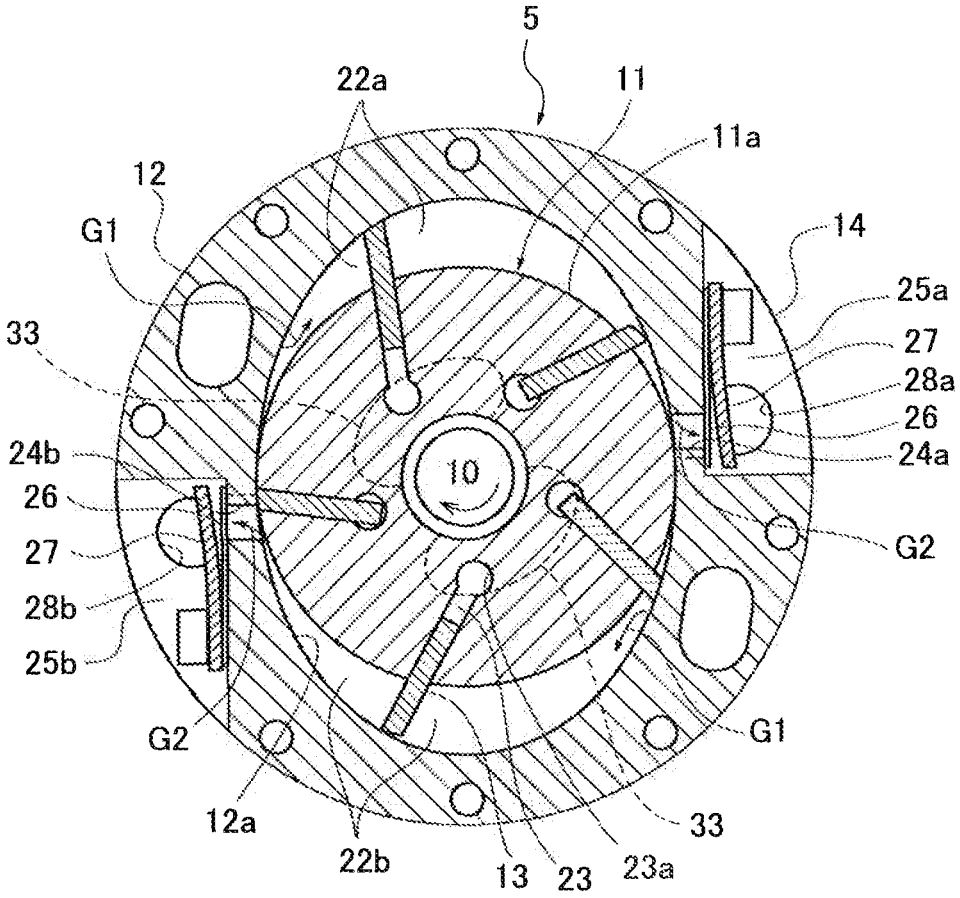
FIG. 8 illustrates a sectional view of the gas compressor along B-B line in FIG. 7.

FIG. 7 schematically illustrates a sectional view of a compressor (sane-rotary type gas compressor) according to Embodiment 2 of the present invention. FIG. 8 illustrates the sectional view of the compressor along B-B line in FIG. 7.

As shown in FIG. 7 and FIG. 8, a compressor 1*a* according to Embodiment 2 does not include the high-pressure-supplying hole which is arranged in the front side block 14 in Embodiment 1 but includes the drain groove 33 only, instead.

Similar to Embodiment 1 as shown in the FIG. 2 and FIG. 6, the compressor 1*a* according to the present Embodiment 2 also includes the drain groove 30 disposed in the rear side block 15. In such a compressor, the outer circumferential edge portion 30*a*1 of the leading end portion 30*a* of the drain groove on the front side of the rotational direction of the rotor is formed so as to increase a distance from the rotational center of the rotor toward the front side of the rotational direction of the rotor. The outer circumferential edge portion 30*a*1 of the leading end portion 30*a* and the end portion 30*a*2 in the circumferential direction are formed linearly. A leading end corner portion 30*a*3 which connects the outer circumferential edge portion 30*a*1 and the end portion 30*a*2 in the circumferential direction is formed in a radial shape.

Similar to Embodiment 1, the sectional area A of the communication portion can be enlarged before the bottom portion 23*a* of the vane groove 23 is separated from the leading end portion 30*a* of the drain groove 30 in Embodiment 2. Therefore, even if the flow rate of the refrigerant oil accumulated in the bottom portion 23*a* of the vane groove 23 from the drain groove 30 increases, the predetermined quantity of refrigerant oil which is accumulated in the bottom portion 23*a* of the vane groove 23 can be flowed (released) to the drain groove 30 side, in the high-speed operation, for example. Thus, the excessive rise of the back-pressure can be prevented.

The outer circumferential edge portion of the leading end portion 30*a* of the drain groove on the front side of the rotational direction of the rotor in the drain groove 30 which is arranged in the rear side block 15 is configured to increase the distance from the rotational center of the rotor toward the front side of the rotational direction in the above-described Embodiments. Such a configuration can be also applied to the drain groove 33 on the front side block 14 side.

According to the gas compressor in Embodiments of the present invention, the outer circumferential edge portion of the back-pressure-supplying groove is formed so as to increase the distance from the rotational center of the rotor towards the front side in the rotational direction of the rotor, and the sectional surface area of the communication portion between the bottom portion of the vane groove and the leading end portion of the back-pressure-supplying groove increases until the bottom portion of the vane groove is separated from the leading end portion of the back-pressure-supplying groove on the front side in the rotational direction of the rotor in accordance with the rotation of the rotor in the final stage of the compression process of a compression medium in the compression room.

Thus, the predetermined amount of the oil accumulated in the bottom portion of the vane groove can be released easily toward the back-pressure-supplying groove before the back-pressure-supplying groove and the van groove become under a non-communicating condition by enlarging the sectional surface area of the communication portion. Thereby, the back-pressure rise before the bottom portion of the vane groove is separated from the leading end portion of the back-pressure-supplying groove is inhibited. Collaterally with the above, the chattering in the vane can be prevented at the same time as the abrasion caused by the fact that the leading end portion of the vane strongly rubs the inner circumferential surface of the cylinder with the excessive rise of the back-pressure can be prevented because the excessive rise of the back-pressure after the bottom portion of the vane groove is separated from the back-pressure-supplying groove can be inhibited.

Although Embodiments of the present invention have been described above, the present invention is not limited thereto. It should be appreciated that variations may be made in Embodiments described by persons skilled in the art without departing from the scope of the present invention.

What is claimed is:

1. A gas compressor comprising:

a compressor main body including an approximately cylindrical rotor which rotates integrally with a rotational axis, a cylinder including an inner circumferential surface having a contour shape which surrounds an outer circumferential surface of the rotor, a plurality of plate-like vanes slidably inserted into a vane groove formed in the rotor, each of the plurality of plate-like vanes having a leading end portion which abuts on the inner circumferential surface of the cylinder through a back-pressure from the vane groove, and two side blocks which cover each leading end portion of both of the rotor and the cylinder, wherein a plurality of compression rooms which are partitioned by the outer circumferential surface of the rotor, the inner circumferential surface of the cylinder, each inside surface of both side blocks, and the vane is arranged inside the compressor main body to compress a compression medium supplied to the compression room and discharge the compression medium at high pressure, a back-pressure-supplying groove which communicates with a bottom portion of the vane groove during compression process of the compression medium and supplies the back-pressure to the bottom portion of the vane so as to project the vane toward the inner circumferential surface of the cylinder is arranged on a surface facing an end surface of the rotor on at least one of the two side blocks, the back-pressure-supplying groove includes a leading end portion having an outer circumferential edge portion, an end portion and a leading end corner portion, and the back-pressure-supplying groove is formed to have a distance in the rotational direction of the rotor between a front side of the outer circumferential edge portion and a rotation center of the rotor, which increases in the rotational direction of the rotor, the leading end corner portion connecting the outer circumferential edge portion and the end portion to configure a radius.

2. The gas compressor according to claim 1, wherein the end portion of the circumferential edge portion is formed linearly, and the bottom portion of the vane groove is separated from the back-pressure-supplying groove by crossing the end portion in the circumferential direction in a final stage of the compression process of the compression medium in the compression room.

3. The gas compressor according to claim 1, wherein the bottom portion of the vane groove communicates with a high-pressure-supplying hole to which a back-pressure which is higher than the back-pressure supplied from the back-pressure-supplying groove is supplied in a non-communication area after the bottom portion of the vane groove is separated from the back-pressure-supplying groove in a final stage of the compression process of the compression medium in the compression room.

* * * * *